US005418037A

United States Patent [19]

Maeder et al.

[11] Patent Number: 5,418,037

[45] Date of Patent: May 23, 1995

[54] FLEXIBLE AND ELONGATED OBJECT

[76] Inventors: Roland Maeder, Schwanenweg 12, CH-9202 Gossau; Gerd Gerhartl, Oberbotsbergstrasse 67, CH-9230 Flawil, both of Switzerland

[21] Appl. No.: 14,524

[22] Filed: Feb. 8, 1993

[30] Foreign Application Priority Data

Feb. 7, 1992 [CH] Switzerland ..... 361/92

[51] Int. Cl.[6] ..... B32B 9/00

[52] U.S. Cl. ..... 428/137; 428/42; 428/48; 428/138; 428/195; 428/196; 428/198; 36/28; 36/44

[58] Field of Search ..... 428/137, 138, 196, 198, 428/195, 48, 42; 36/44, 43, 28

[56] References Cited

U.S. PATENT DOCUMENTS 4,602,442 7/1986 Revill et al. ..... 36/44
4,729,179 3/1988 Quist, Jr. ..... 36/44
4,805,319 2/1989 Tonkel ..... 36/28
4,843,739 7/1989 Von Blücher et al. ..... 428/196
4,864,740 9/1989 Oakley ..... 36/44
4,893,418 1/1990 Ogden ..... 36/44
4,925,724 5/1990 Ogden ..... 428/138

*Primary Examiner*—Patrick J. Ryan
*Assistant Examiner*—Abraham Bahta
*Attorney, Agent, or Firm*—Jacobson, Price, Holman & Stern

[57] ABSTRACT

A flexible and elongated composite material which is intended to be placed on a flat surface of an at least essentially rigid and also elongated composite material including a flat composite material which is designed to be placed on the rigid object. The composite material of the flexible object has a supporting layer. A stabilization layer is assigned to that one side of the supporting layer which is intended to face the rigid object. The stabilization layer is designed to give the composite material a necessary rigidity. Grooves are in at least one of the surfaces of the composite material. An adhesive agent is applied to certain points or areas of that surface of the composite material which is intended to be placed on the flat surface of the rigid object.

22 Claims, 2 Drawing Sheets

FLEXIBLE AND ELONGATED OBJECT

BACKGROUND OF THE INVENTION

The present invention relates to a flexible object, in particular a shoe insole having a flat basic body, which is designed to form a layer on another object which, in turn, is at least essentially rigid.

Flexible objects of this generic type are widespread. It is, above all, shoe insoles which are of particular interest in the present case. One of the known insoles, disclosed in Swiss Patent Application Number 2964/89-8, has an absorbent layer which contains a material similar to cotton. On the upper side of this absorbent layer there is a layer of fibers which prevents the wearer's foot from coming into contact with the material in the absorbent layer. This is necessary as the material used in the absorbent layer is not very resistant to abrasion. The other surfaces of the absorbent layer are covered with fleece or tissue which give the shoe insole the stiffness required for this application. The whole of the underside of this layer of material has an anti-slip coating.

In using such an insole, it has been found that the anti-slip coating prevents the insole from slipping whilst in the shoe, but that it also prevents the insole from returning to its original, flat position if it should happen to slip in spite of the anti-slip coating. This is considered to be a disadvantage of the known insole.

SUMMARY OF THE INVENTION

The object of the present invention is to indicate a flexible object, in particular a shoe insole, which does not have the stated disadvantage and which furthermore offers additional advantages.

According to the invention, the stated object is achieved in a flexible object such as a shoe insole having a flat basic body, which is designed to form a layer on another object which, in turn, is at least essentially rigid and has a flat surface, wherein an adhesive or bonding agent is applied to certain points or areas of that surface of the flexible object which is intended to be placed on a flat surface of a rigid object.

BRIEF DESCRIPTION OF THE DRAWINGS

Embodiment possibilities of the present invention are explained in greater detail below with reference to the attached drawings, in which.

DESCRIPTION OF THE PREFERRED EMBODIMENTS

Figure 1:
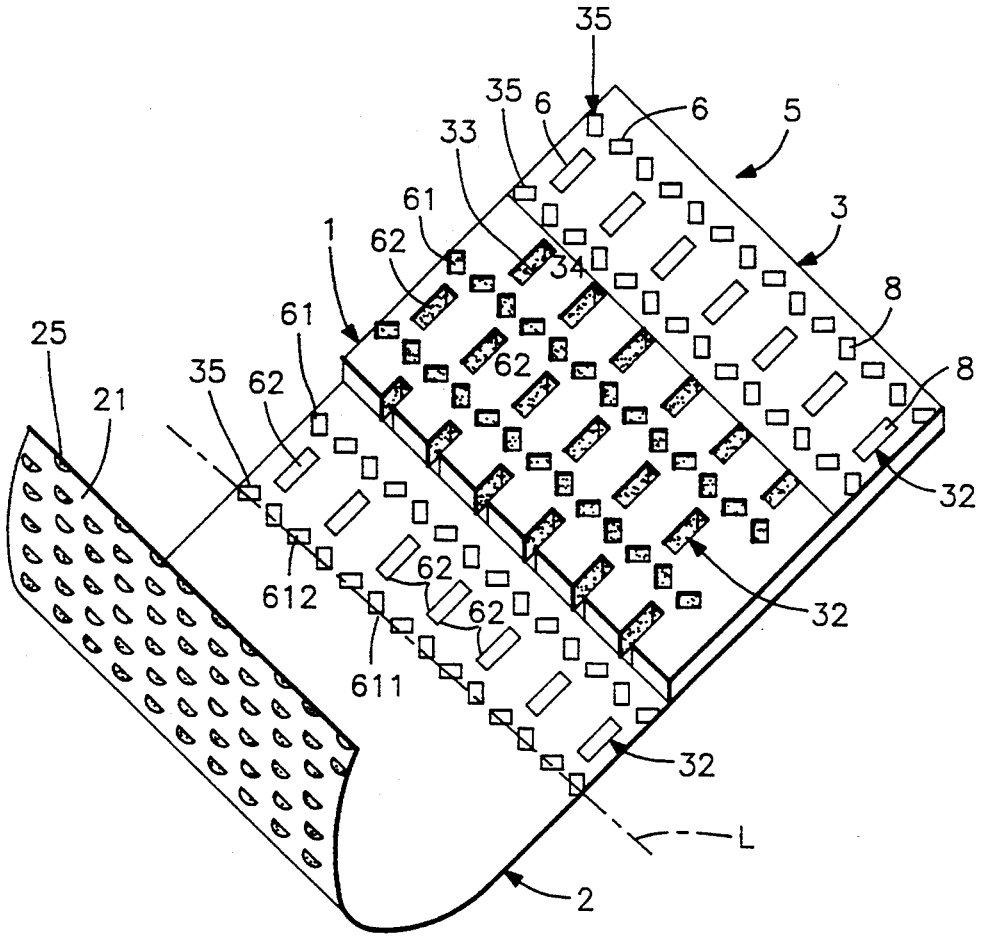
FIG. 1 shows in perspective a flat and flexible object, which can depict a part of a shoe insole, for example.

The object, which is represented in perspective in FIG. 1, can represent a part of an insole. The present object can, however, represent a compartment part of other objects too. Such objects can, for example, be made of textile fabric, compact synthetic material, glass, metal, mineral, fleece, felt, foam, leather, imitation leather, etc. Such objects can be designed to be placed on a flat surface of an object, which in turn can be made from leather, imitation leather, wood, marble, stone, metal, glass, compact synthetic material or which has a textile surface. To make it easier to understand the description of the present invention, this is explained below in connection with its application as a component of a shoe insole.

Figure 2:
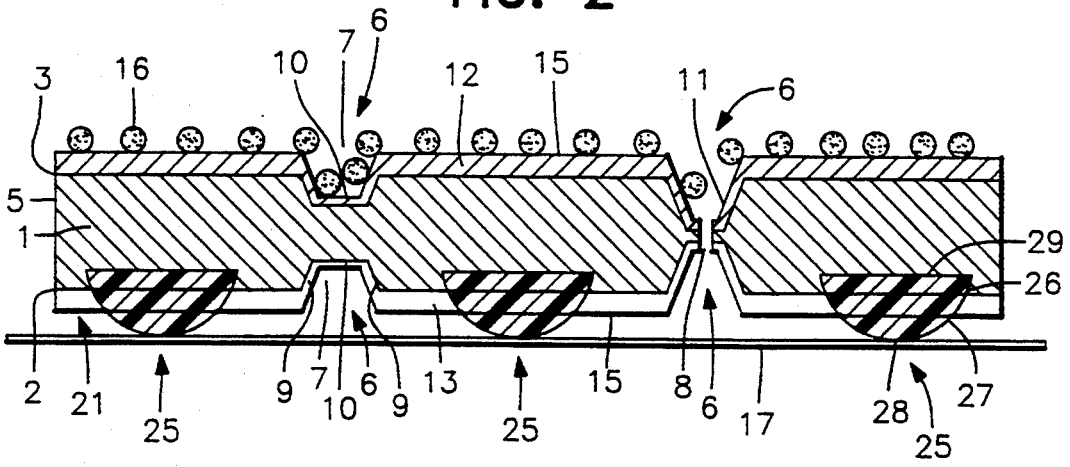
FIG. 2 shows a vertical section of an insole, having the object according to FIG. 1 as one of its components.

FIG. 2 shows a vertical section of a shoe insole onto which the stated flexible object is attached. This insole has an absorbent layer 1, the thickness of which in the finished product is essentially determined by the thickness of this product. In the finished product, the thickness of the absorbent layer 1 is between 1 mm and 5 mm. The absorbent layer 1 extends advantageously over the entire surface of the insole. Loosely carded wadding or wadding scraps, which are obtained in the manufacture of other wadding products, can form the material of this absorbent layer 1. The wadding can comprise exclusively cotton fibers or it can be a mixture of different fibers. For example, this layer can contain cotton fibers and viscose fibers, which are connected to one another with the aid of a fiber made of a suitable material. A binding fiber such as this can be a synthetic fiber and, in particular, polyethylene fibers can be used. The absorbent layer can also contain 70% cotton or viscose fibers and 30% polypropylene fibers.

A stabilization layer 2 is attached to the absorbent layer 1 and this stabilization layer 2 is situated on the side of the absorbent layer 1 which faces towards the insole of the shoe. The stabilization layer 2 is designed to give the insole the necessary rigidity to insert the same into a shoe. Furthermore, this layer 2 is designed in such a manner that it acts in a slip-resistant manner while the shoe is being worn.

The mutual assignment of the said layers 1 and 2 takes place in such a manner that one of the surfaces of the absorbent layer 1 is connected to one of the surfaces of the stabilization layer 2. No special process is needed to connect these two layers 1 and 2 since the cohesion of the layers or of all the layers of the present insole is achieved by means of a special type of perforation of the insole semifinished product. The perforation process is described in greater detail below.

The stabilization layer 2 is made of a fibrous material, in which the fibers form several plies. The material in this layer must be a sealable material. It can be a fleece or a tissue. If layer 2 is made of a fleece, it can advantageously contain viscose fibers. These fibers can be approximately 40 mm long and 3.8 decitex in thickness. The fibres of the fleece are connected to one another with the aid of a binder. Such a mixture can contain 75% fibers and 25% binder. The binder can be based on synthetic rubber.

This lower fleece 2 can, however, be made of 100% polypropylene. This material advantageously contains colored pigments, which makes it easier to tell the difference between the top and bottom surfaces of the shoe insole.

The fibers in the fleece of the stabilization layer 2 are assigned in such a manner that they lie parallel to one another. Such a fleece is also called longitudinal ply fleece. The direction of the fibers lying parallel to one another practically coincides with the longitudinal direction of the insole. In certain circumstances, it can be advantageous if the angle between the direction of the fibers and the longitudinal direction of the insole is not equal to zero. This can be the case, for example, to prevent the insole from slipping at an angle to the longitudinal direction of the shoe or insole.

In applications where no great stress of the insole is expected or where the insole is to be a product which is very inexpensive to manufacture, the stabilization layer 2 can be made of a tissue. The surface of the tissue must be as coarse or undulating as possible. For example, crepe paper can be used for such purposes.

A layer 3 is assigned to the side or surface of the absorbent layer 1 facing away from the stabilization layer 2. This layer 3 can also be described as a covering layer 3. This covering layer 3 advantageously covers the upper side of the absorbent layer 1 completely and, consequently, it forms the upper edge of the shoe insole. The upper surface ply 3 is designed in such a manner that, although it can be permeated by foot sweat, it cannot be made wet by this liquid. By virtue of this design, the covering layer 3 also forms a separation piece between the absorbent layer 1 and the wearer's foot.

The surface ply 3 is made of fibers which form at least one ply. These fibers must be made of a relatively tear-resistant material became the body weight of the user of the present insole must be borne by these fibers, as will become clear from the following description. The fibers of the upper surface ply 3 can form a fleece or a web.

The fleece of the covering layer 3 can be made of up to 100% polypropylene, wherein this layer or the fibres of the layer can be colorless. This covering layer 3 must be a different color to the stabilization layer 2 so that the stated optical or color differences make it easy to differentiate between the upper and lower sides of the insole. It is necessary to be able to tell the difference between the two sides easily as only the underside of the insole is slip- resistant.

The basic body 5 of the insole has grooves 6 in at least one of the sides or surfaces of the basic body 5. In the depicted case, the grooves are present on and in both sides of the basic body 5. These grooves can take the form of depressions or blind holes 7 and/or holes or through-openings 8. If the grooves 6 take the form of through-holes 8, these holes 8 are to enable or encourage the flow of air transversely through the shoe insole.

In the illustrated case, the depressions 7 in the opposite sides of the basic body 5 are located opposite one another. It is however possible for the depressions in the opposing sides of the basic body 5 to run at angles to one another in the surface of the insole's basic body 5 (not depicted). In such a case, the central axes of the depressions 7 which run at angles to one another do not meet up.

The grooves 6 are produced in such a way that the ply material or the basic body 5, having layers 1, 2 and 3, is guided between heated rollers of a calender. Both rollers have projections—higher projections, approximately half the thickness of the shoe insole, or lower projections where the height is less than half the stated thickness. The projections stand away from the surface of the respective heated roller like thorns and they advantageously take the form of a truncated pyramid. This truncated pyramid has either a square or rectangular base and is connected to the roller by its larger area. The spikes are distributed across the surface of the respective heated rollers in such a way that they form a pattern. If the grooves 6 are to lie exactly opposite one another in the opposing sides of the basic body 5, the calender rollers are driven in synchronization so that the central axes of the opposing roller spikes meet.

When the heated projections are pressed into the upper side 3 or the lower side 2 of the ply body 5 during the calendering process of the semifinished product of such an insole, the front facings of the truncated pyramid and at least one section of the pyramid wall connected to the front facings penetrate layers 1, 2 and 3 of the basic body 5. The front facings of the truncated pyramid push or press the material in plies 1 to 3 in front of them and push this material into the absorbent layer 1.

As the fibers of the stabilization layer 2 and the covering layer 3 are thermoplastic, the fibers or sections of fibers located in the area of action of the respective spike are, after appropriate heating, drawn down into and at the same time to the side of the layered body by the sections of the side walls of the truncated pyramid adjoining the front facing of the projection. The thickness of this drawn section 9 of the outer material layers 2 or 3 can decrease if the depth of the groove 6 is greater than the diameter of the outer opening of this groove 6. In this way, converging material channels 9 are formed in the outer layers 2 and 3 and these channels 9 run obliquely and towards the inside of the basic body 5. These channels 9 are located inside the ply body 5; they form a lining on the side walls of the projections 6 and the thickness of this lining 9 can decrease as the depth of the projection 6 increases.

The shorter or lower roller spike leaves a depression 7 in the ply body 5. This depression 7 has side walls 9 as stated and a base 10. The fiber material of this depression base 10 forms a continuous layer with the fiber material of the side linings 9. This base 10 is formed by the material of the outer layers 2 or 3 which has been pushed in by the front facings of the truncated pyramid in question. The fiber material of the absorbent layer 1 is pressed between the bases 10 of the opposing depressions 7. The thickness of this fiber layer can be adjusted by choosing different heights of the shorter roller spike or by altering the distance between the calender rollers.

A hole 8 is produced in the ply body 5 by two longer roller spikes which are located opposite each other. When pressed into layers 1 to 3, the front facing of the roller spike in the shape of a truncated pyramid penetrates the outer fiber layers 2 and 3. When the front facings of the opposing spikes meet, the remaining material of the outer fiber layers 2 and 3 together with the material in the absorbent layer 1, which for the moment remained between the roller spikes, is forced out of the space between the spike facings to the side where the material accumulates 11. As the material of at least the outer layers 2 and 3 is also sealable, the inner edges of the linings 9 are welded together in the opposing grooves 6 and the stated accumulations of material 11 form the weld seam.

The inner wall of hole 8 has two wall sections 9, each of which takes the form of a casing of a truncated pyramid. The narrower sections of these truncated pyramids face each other and are joined together with the aid of a welding seam 11. Correspondingly, the diameter of the hole 8 is smallest approximately in the middle of the thickness of the basic body 5.

The fibers of the outer layers 2 and 3 are, for example, 4 cm long. The diameter of the opening of the respective groove 6 is approximately 1 mm and the distance between two neighboring grooves 6 is only a few millimeters. Between two grooves 6 made from one of the outer fiber plies 2 and 3 in the basic body 5, there is a practically unshaped section 12 or 13 of the outer fiber layer 2 or 3.

In the area of the wall sections 9, parts of the length of the fibers of the outer plies 2 and 3 are bent into the inside of the grooves 6, drawn into the grooves 6 and fixed. Because of the given length of the fibers, the fibers form a roughly arched or curved structure. The end sections of this arch are located near the wall linings 9 of the grooves 6, where they are also secured. The middle section of this arch lies in the unshaped area 12 or 13 of the fiber layer 2 or 3. There is an extraordinarily large number of arches in the fiber layers 2 and 3 and such arches form a support for the shoe insole and give it a rigidity which is relatively large given the narrowness of the insole.

Where the grooves 6 are in the form of holes 8, the ends of the roughly arched fiber sections of one of the fiber layers 2 or 3 are held together by the welding seam 11 in the middle area of the hole 8. With the aid of a welding seam, these fiber ends are firmly secured to the ends of the fibers of the opposing outer fiber layer 3 or 2, which are also located in the central area of the depth of the hole 20.

Where the grooves 6 are only in the form of depressions 7 with a base 10, the end sections of the arched fibers of the outer fiber layers 2 and 3 are held in the area of the stated base 10. This is due to the fact that they have been compressed and welded together in the area of the base 10 as a result of the effect of heat and pressure.

As the grooves 6 do not only lie in one row (FIG. 2) but rather are distributed across the surface of the basic body 5 (FIG. 1), the roughly arched sections 12 or 13 of the surfaces layers 2 and 3 run in practically every direction. This results in a three-dimensional skin 15 on the respective surface of the basic body which increases the rigidity of the basic body. The material of the absorbent layer 1 lies between the skim 15 on both sides of the basic body 5 and it is both enclosed and partially compressed by these skins. This further improves the rigidity of the basic body 5.

The object has active ingredients. These are in the form of a liquid and this liquid is enclosed in microfine gelatine capsules 16 or similar. These capsules 16 can be distributed over the surface of the coveting layer 3, where they can be exposed to a direct influence from both body warmth and foot pressure. There can also be individual capsules 16 in the grooves 6. These capsules only release their contents at a later stage, prolonging the length of time during which the released ingredients are effective. The capsules 16 can also be accommodated in the covering layer 3 or even in the lower layers 1 and 2. The capsules 16 are burst as a result of the effects of body heat and the changing stress on the insole and the contents of the same are released. As not all capsules are burst immediately, the active ingredient can be delivered over a longer period of time.

The active ingredient can be a fragrance or a special active ingredient such as a fungicide, antiperspirant, bactericide or similar.

One of the sides or surfaces 21 of the basic body 5 of the flexible object is intended to be placed on a flat surface 17 of an object which is at least essentially rigid. In certain places or in-certain areas, an adhesive or bonding agent is applied to this side 21 of the flexible object.

The bonding agent material forms islands 25 which are embedded in the adhesive side 21 of the basic body 5 of the object. The islands 25 have a flat surface 26 and a rounded surface 27. The flat surface 26 is located below the surface of the basic body 5 or the stabilization layer 2 and it allows the island 25 in the material of the basic body 5 to be firmly secured. On the other hand, the rounded surface 26 juts out of the surface of the adhesive side 21 of the basic body 5. The crown 28 of this rounded surface 27 is designed and formed to be placed on the object 17.

The islands 25 advantageously have a circular circumference. The diameter of this circumference measures roughly 1 mm or less. The vertical longitudinal section of the islands 26 can take the form of a hemisphere or spherical cap. The height and form of the island 25 is selected so that it can be firmly secured in the material of the basic body 5. The half spherical or cap shaped island 25 is sufficient for this requirement because the largest width of the flat surface 26 of such an island 25 lies near the basic area 29 of the flat surface 26.

The stabilization layer 2 can have a thickness of only a few tenths of a millimeter. In such a case, roughly one half of the height of the hemisphere 25 can represent the flat surface 26 and the other half of the hemisphere can represent the rounded surface 27, which juts out of the stabilization layer 2. As the height of the flat surface 26 is greater than the thickness of the stabilization layer 2, the lowest and widest section 29 of the flat surface 26 is even embedded in the material of the absorbent layer 1. As the side walls of the hemisphere or spherical cap converge in a path from the basic area 29 towards the crown 28, the material of the absorbent layer 1 and the lower, outer fiber layer 2 rest against or on these side walls and assist in keeping the islands 25 in the basic body 5.

Suitable measures are taken to ensure that, when it is applied, the material of the bonding agent penetrates far enough into material of the basic body 5 that the adhesion of the bonding agent in the material of the basic body 5 is greater than that of the islands 25 on the object 17 later on.

The bonding agent is made of a material with virtually permanent adhesion, even after it has set. This material can contain latex. The composition of the bonding agent material is such that the cohesion in the material is greater than the adhesion of this material with regard to the material of the object 17 onto which the flexible object 5 is intended to rest. The material of the bonding agent can contain a colorant and/or scent and other active ingredients. The material of the bonding agent 25 can contain synthetic compounds such as nitrile latex, acrylic latex, styrene latex etc. This material can form a paste or powder or a film and suitable techniques are used to apply it to the basic body 5.

A paste, which is designed to be applied to the basic body 5 in order to form the islands on this body 5, has the following composition:

850 parts nitrile latex dispersion 45%
18 parts emulsified white oil, nonionic
45 parts acrylate 55%
45 parts acrylic acid 25%
42 parts ammonia water.

This mixture results in a paste with approximately 100 to 110 poise viscosity, which is printed as a pattern onto the basic body using a screen printing machine. After the drying process at approximately 140° C., the water in the paste is vaporized and a grid of slightly sticky islands 25 remains. These islands 25 constitute the actual bonding agent.

By using a computer, the distribution of the bonding agent islands 25 over the surface of the basic body 5 can be calculated is such a way that it is correct for the respective application. This is possible since the bonding material forms points or only small areas of island 25. With the aid of an estimate, the intensity of the object's adhesion on an object 17 can be set to suit the respective purpose by selecting a suitable number of islands 25 depending on the surface unit of the basic body 5. This has not been possible until now as the adhesive surface had been completely covered with the material of a bonding agent. The adhesive quality could only be adjusted by varying the adhesive material, which was very tedious. In the present case, the material of the bonding agent does not have to be changed. According to the present invention, it is enough to change the number and/or the size of the islands 25. In the printing machine in question, these changes can be carried out easily. Further, the islands 25 make it possible to achieve varying adhesive qualities in certain areas of the same object, which was not previously possible.

The flexible object shown in perspective in FIG. 1 shows the middle layer 1, the lower layer 2 and the covering layer 3 of the sole according to FIG. 2. The lower side of the second or lower layer 2, which is thinner than the first layer 1, has islands 25 on it, as described. A basic body 5 of this kind has grooves 6 on it, as previously described. These grooves 6 take the form of holes 8, which penetrate all three layers 1 to 3. It goes without saying, however, that these grooves 6 can also be in the form of depressions 7 only, or that a basic body 5 of this type can have both depressions 7 and holes 8.

Figure 3:
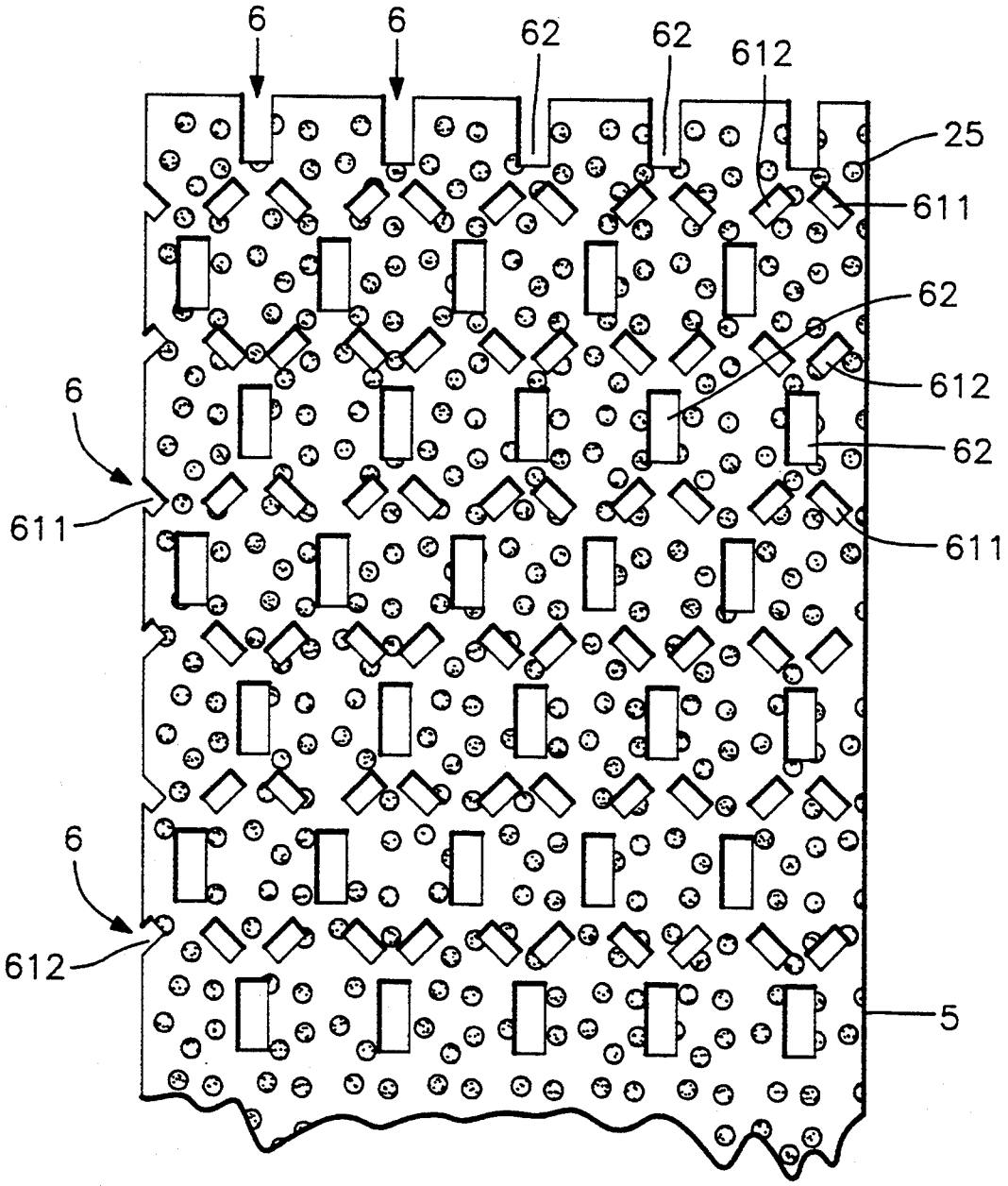
FIG. 3 shows a horizontal projection of a section of the object according to FIG. 1.

The object has numerous grooves 6, which form a pattern. A pattern is shown in FIGS. 1 and 3, which contains two types of grooves 6, actually holes 8. Both types of grooves 6 have a rectangular profile. The length of the first grooves 61 is smaller than the length of the second grooves 62. The width of grooves 61 and 62 of both types is approximately the same.

In the basic body 5, the longer grooves 62 form rows 32 which run parallel to one another and a distance from each other. The grooves 62 in the respective rows 32 are oriented in such a way that the longer sides 33 of the same run parallel to one another. The distance between two grooves 62 lying next to one another is greater than the shorter sides 34 of the groove 62. The grooves 62 in the adjacent rows 32 are obliquely assigned to one another in such a way that one of the grooves 62 of one row 32 is practically in the middle of the gap between two neighboring grooves 62 of the adjacent row 32.

The shorter grooves 62 also form rows 35 which run parallel to one another and a distance from each other. Each one of these rows 35 lies between two rows 32 with the longer grooves 62, in such a way that the two types of rows 32 and 35 alternate with one another. The longer sides of the shorter grooves are at an angle to the longitudinal axis L of the respective row, wherein the side walls form varying angles with the longitudinal axis L of row 35. There are two types of these shorter grooves. In the case of the first grooves 611, the angle between the side wall of the same and the longitudinal axis L of this row is 135°. In the case of the second grooves 612, the angle between the side walls of the groove 612 and the longitudinal axis L is only 45°. Between two grooves of the first type, eg, of 611, there is a groove of the second type, ie, 612, so that these two types of grooves 611 and 612 alternate with one another.

With regard to the longer grooves 62 of the two rows 32 directly next to each other, the shorter grooves 611 and 612 of a row 35 are oriented and assigned in such a way that the side walls of the shorter grooves 611 and 612 run parallel to a line which connects the end sections of the adjacent rows' longer grooves 612 which are assigned at an angle to one another.

Two shorter grooves 611 and 612 of row 35 are assigned to one end section of two adjacent, longer grooves 62 in one of the adjacent rows 32. These shorter grooves 611 and 612 converge with increasing distance from the longer grooves 62. The closer end sections of these shorter grooves 611 and 612 are assigned to one end of one of the longer grooves 62 in row 32, which is located on the other side of the row 35 with these shorter grooves 611 and 612. In this way, a hexagonal pattern can be seen on the object, with two longer rectangular grooves 62 adjacent to one another forming the two longer sides of a hexagon. One pair of converging, shorter grooves 611 and 612 is assigned to each of the end sections of these longer grooves 62.

An important feature of the present invention is that the islands 25 of adhesive material on the underside of the object are only located in those areas of the basic body 5 which lie between adjacent grooves 6 in the basic body 5. This is shown in FIG. 3, in which there is a horizontal projection of a section of the object according to FIG. 1.

The material which has the adhesive agent 25 on is only partially coated. The basic body of the object therefore remains permeable to air and moisture, if this was previously the case.

What is claimed is:

1. A flat flexible elongated composite material which is intended to be placed on a flat surface of an at least essentially rigid and elongated object, said material comprising a basic body with a top and a bottom surface wherein the basic body comprises at least an absorbent supporting layer having a top and a bottom surface and a stabilization layer fixed to the bottom surface of the supporting layer, said stabilization layer being adapted to give the basic body rigidity in the longitudinal direction of said material and being adapted to face said object, said basic body having grooves in at least one of the surfaces thereof, and said basic body having an adhesive agent applied to preselected portions of the surface intended to be placed on the flat surface of the at least essentially rigid and elongated object.

2. A flat flexible elongated composite material according to claim 1, wherein the stabilization layer contains fibers forming at least one ply, said fibers being composed of a sealable material and lying parallel to one another and parallel to the longitudinal direction of the composite material, the fibers forming between the neighboring grooves a roughly arched or curved shape, whereby the middle section of the arched area of the fibers lies in a non-shaped area of the fiber-containing stabilization layer, and wherein the fibers extending into the area of the grooves are bent and drawn down into the grooves and the ends of the bent and drawn fibers in the grooves are fixed inside the composite material.

3. A flat flexible elongated composite material according to claim 1, wherein the basic body further comprises a covering layer fixed to the top side of the absorbent supporting layer, whereby said covering layer is permeable to foot sweat but not wettable.

4. A flexible and elongated composite material according to claim 1 wherein the covering layer further comprises at least one active ingredient selected from the group consisting of a fragrance, a fungicide, an antiperspirant, and a bactericide.

5. A flat flexible elongated composite material which is intended to be placed on a flat surface of an at least essentially rigid elongated object, said material comprising an absorbent supporting layer having top and bottom sides, a stabilization layer fixed to the bottom side of the supporting layer, said stabilization layer being adapted to face the rigid object and being adapted to give the material rigidity, said material having grooves in at least one of the surfaces thereof, and an adhesive agent applied to predetermined portions of that surface of the stabilization layer which is intended to be placed on the flat surface of said rigid object.

6. A flexible and elongated composite material according to claim 5, wherein the stabilization layer contains fibers forming at least one ply, said fibers being of a sealable material and lying parallel to one another and parallel to the longitudinal direction of the flexible object as well.

7. A flexible and elongated composite material according to claim 5, further comprising a covering layer fixed to the top side of the absorbent supporting layer, said covering layer being permeable by foot sweat but not wettable.

8. A flexible and elongated composite material according to claim 7, having said grooves on both sides thereof, the respective grooves on both sides being located opposite one another, each groove having the shape of a truncated pyramid which penetrates the outer layers of the material, the pyramid having a square or rectangular base and wherein the narrower sections of the grooves face each other.

9. A flexible and elongated composite material according to claim 8, wherein each of said supporting layer, stabilization layer, and covering layer comprises fibers, the fibers form between the neighboring grooves a roughly arched or curved structure, whereby the middle section of the arched area of the fibers lies in a non-shaped area of the fiber layer, in the area of the walls of the grooves parts of the length of the fibers of the plies of the composite material are bent and drawn down into the layered composite material, and wherein the end portions of the bent and drawn fibers are fixed in the interior of the respective groove and form a casing of said truncated pyramid.

10. A flexible and elongated composite material according to claim 9, wherein the grooves take the form of depressions or blind holes in the composite material, in the bottom region of the respective groove there is a base which adjoins the walls of the groove and wherein the fiber material of the depression base forms a continuous layer with the fiber material of the side linings.

11. A flexible and elongated composite material according to claim 9, wherein the grooves are holes or through-openings in the composite material, the material in the place of this hole, where the opposed pyramids meet one another, forms an accumulation or a welded seam in the middle part of the hole and wherein the ends of the fibers are embedded in this seam.

12. A flexible and elongated composite material according to claim 8, wherein the grooves form a pattern which contains two types of grooves, both types of grooves having a rectangular profile, the length of the first grooves being smaller than the length of the second grooves, the width of grooves of both types being approximately the same, the second, longer grooves, form spaced apart rows which run parallel to one another, the first, shorter grooves, also form spaced apart rows which run parallel to one another, and wherein each one of these second rows lies between two rows with the longer grooves.

13. A flexible and elongated composite material according to claim 12, wherein the longer grooves in a row are oriented in such a way that the longer sides of the same run parallel, and the grooves in the adjacent rows are situated obliquely to one another in such a way that one of the grooves of one row is essentially in the middle of the gap between two neighboring grooves of the adjacent row; the longer sides of the shorter grooves are at an angle to the longitudinal axis of the row, there are two types of the shorter grooves, the angle between the side walls of the grooves of the first type and the longitudinal axis of this row is 135 degrees, the angle between the side walls of the grooves of the second type and the longitudinal axis of this row is 45 degrees, and wherein between two grooves of the first type there is a groove of the second type.

14. A flexible and elongated composite material according to claim 5, wherein said predetermined portions which have an adhesive agent comprise at least one island made of said adhesive agent and wherein the composition of the material of the adhesive agent is such that the cohesion thereof is greater than the adhesion thereof with regard to the material of the object on which the composite material is to be placed.

15. A flexible and elongated composite material according to claim 14, wherein the adhesive agent is made of a material which remains almost permanently adhesive, even after setting, whereby this material can contain latex.

16. A flexible and elongated composite material according to claim 14, wherein the material of the adhesive agent contains colorant.

17. A flexible and elongated composite material according to claim 14, wherein the material of the adhesive agent forms islands in the adhesive surface of the composite material, the islands have a flat part and a rounded part and wherein the flat part of the island is located under the facing of the adhesive side of the composite material and the rounded part thereof is located out of said facing.

18. A flexible and elongated composite material according to claim 14, wherein the islands have a circular circumference.

19. A flexible and elongated composite material according to claim 14, wherein the islands are embedded in the side of the composite material which comprises the stabilization layer, the stabilization layer being thinner than the absorbent layer and wherein the islands are at least embedded in the thinner layer.

20. A flexible and elongated composite material according to claim 14, wherein the grooves form patterns in the surface of the composite material and wherein the islands are located in those areas of the composite material which lie between adjacent grooves.

21. A flexible and elongated composite material according to claim 5, in the form of a shoe insole.

22. A flexible and elongated composite material according to claim 1, wherein the material of the fibers contains dye.

* * * * *